United States Patent [19]

Grüssel et al.

[11] Patent Number: 4,718,255

[45] Date of Patent: Jan. 12, 1988

[54] COMBINED KNITTING AND LOOP TRANSFER CAM ARRANGEMENT FOR KNITTING MACHINES

[75] Inventors: Klaus Grüssel, Limbach-Oberfrohna; Günther Kessler; Günther Tröbs, both of Karl Marx Stadt, all of German Democratic Rep.

[73] Assignee: Veb Kombinat Textima, Karl Marx Stadt, German Democratic Rep.

[21] Appl. No.: 878,130

[22] Filed: Jun. 25, 1986

[30] Foreign Application Priority Data

Jun. 25, 1985 [DD] German Democratic Rep. ..... 2777184

[51] Int. Cl.[4] ..... D04B 7/00

[52] U.S. Cl. ..... 66/78

[58] Field of Search ..... 66/78, 71, 76

[56] References Cited

U.S. PATENT DOCUMENTS

| | | | |
|---|---|---|---|
| 4,154,067 | 5/1979 | Grimmer et al. | 66/78 |
| 4,413,482 | 11/1983 | Steiger | 66/78 |
| 4,463,579 | 8/1984 | Schimko et al. | 66/78 X |
| 4,545,219 | 10/1985 | Schmodde | 66/78 X |

FOREIGN PATENT DOCUMENTS 145117 11/1980 German Democratic Rep. .

*Primary Examiner*—Ronald Feldbaum

*Attorney, Agent, or Firm*—Michael J. Striker

[57] ABSTRACT

In a combined knitting and loop transfer cam system for a knitting machine a switchable pressing strip for pressing the knitting needles is arranged at the height of the inflow members over a region of the a selecting system for selecting sinkers in correspondence with the knitting needles. A switchable cam for an adjustment of the tuck and loop position is subdivided into two portions one of which is displaceable in the direction of elongation of the needles.

5 Claims, 5 Drawing Figures

COMBINED KNITTING AND LOOP TRANSFER CAM ARRANGEMENT FOR KNITTING MACHINES

BACKGROUND OF THE INVENTION

The present invention relates to a combined knitting and loop transfer cam arrangement for knitting machines, particularly for flat knitting machines.

The cam arrangements of the foregoing type are normally installed in the knitting machines including at least one pair of needle beds over which a knitting carriage is moved in one direction, and in which sinkers are provided in correspondence with the needles sinking in the needle beds. The cam arrangement can be modified to be used in round knitting machines.

A combined knitting and loop transfer cam arrangement for flat knitting machines of the type under consideration has been disclosed in DD-PS No. 145,117. The machine comprises a knitting carriage running in one direction, a tuck cam, a drive member switchable for knitting, a loop-sinking cam, cams for transferring loops from one needle bed to the other needle bed, and a multi-part partially switchable guard cam. In this cam arrangement, a drive cam for the tuck loop formation is formed as a loop transfer cam and a part of the guard cam is formed as a loop-sinking cam. A switchable deflecting cam is arranged before the drive cam for the tuck loop formation and the loop transfer cam. The loop transfer cam is subdivided into a stationary drive cam and a loop transfer cam adjustable in height. A vertically adjustable cam with a cover for raising the needles is positioned between the deflecting cam for guiding the needles to the loop transfer position, and the guard cam is stationary whereas a switchable cam for drawing off the needles is subdivided into portions. This cam system has, however, the disadvantage which resides in the fact that in order to arrange there a selecting system for selecting needles and sinkers a further space or room is required. Furthermore, in addition to the stitch or loop transfer member a specific rigidly mounted tuck cam is required. Finally, for a reliable operation of the open tongues for carrying out the knitting and loop-transfer process, specific tongue-opening cams are additionally required.

SUMMARY OF THE INVENTION

It is an object of the present invention to provide an improved combined knitting and loop transfer cam arrangement for a knitting machine.

It is a further object of the invention to expand possibilities of pattern knitting in flat knitting machines in which a knitting carriage, movable in one direction, is provided.

Yet another object of the present invention is to increase output and improve quality of knitting in the knitting machines of the foregoing type.

Still a further object of the invention is to provide a combined cam system with a full integration of the loop transfer cams and a pattern-depending needle selection in the knitting cam with an optimal adjustment of individual cams one after the other, and which would not require a great deal of space.

These and other objects of the present invention are attained by a combined knitting and loop transfer cam arrangement for knitting machines, comprising a knitting carriage running in one direction over needle beds, knitting needles, sinkers in accordance to which the knitting needles are selected for a pattern-responsive knitting process, pressure bars for pressing the knitting needles away from an influence range of a cam system, inflow cams, loop transfer cams, tuck cams and drive cams, cleaning cams and, limiting cams, wherein a tuck cam serves at the same time for loop receiving and for separating a knitting needle course for a loop delivery-and-transfer process, and a first switchable cam for loop transfer and tuck formation, a switchable pressure bar for pressing the knitting needles during a sinker selection; a selecting system for sinkers, said switchable pressure bar being arranged at the height of said inflow cams over a region of said selecting system, a tuck drive cam positioned subsequent to said first switchable cam for an optimal adjustment of a tuck-and-loop taking position and being subdivided into a first cam displaceable in the direction of elongation of the needles and a second cam displaceable in the direction of moving of the knitting carriage; a second switchable cam for a form-locking guidance of the knitting needles in the region of a full drive member and for releasing a path for the knitting needles moved from a loop transfer position to a limiting cam; and combing cams for adjustment to a material being knitted and to a binding being formed in the direction of raising the needles.

The inflow cams may be provided with a recess for collecting the knitting needles pressed by said pressure bar.

The cam may be formed as a rotation element provided with a channel for guiding the knitting needles in a form-locking fashion in the region of at least a loop delivery cam and said second cam.

The full drive cam may be subdivided into a first switchable cam for drawing off the knitting needles and a second cam for guiding the knitting needles to an outlet position for enabling the knitting needles to be drawn at different times after the tuck loop formation or loop delivery and the loop formation or loop transfer have taken place.

A guide cam may be provided with a forwardly projecting extension formed as a pivotable cam tongue positioned below the full drive cam for enabling the knitting needles to be drawn off at different times after the tuck loop formation or loop transfer and the loop formation or loop delivery.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 5:
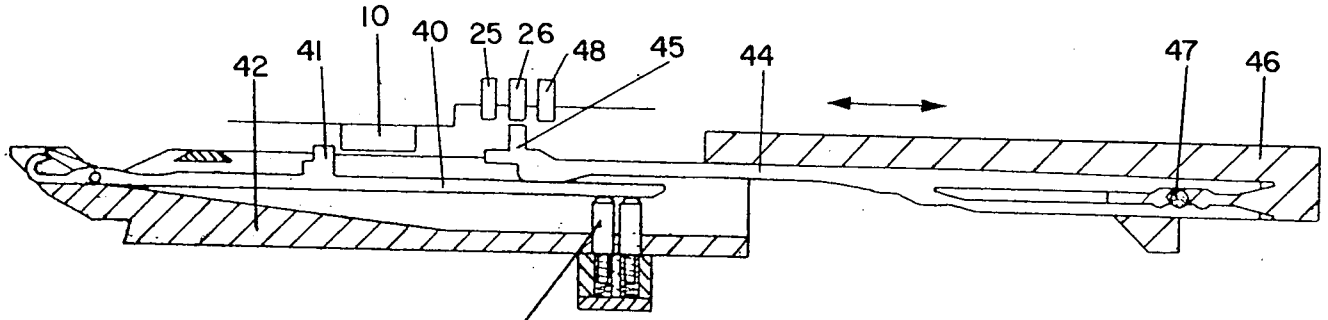
FIG. 5 is a partial sectional view of a conventional needle-and-sinker arrangement of the knitting machine.

For the sake of clarity, a conventional arrangement of a needle and a sinker of a knitting machine is illustrated in FIG. 5 which shows a needle bed 42 and a knitting needle 40 having a needle foot 41. The knitting needles 40 are positioned in the needle bed 42. The shaft of each needle is supported on spring pins 43. Sinkers 44 each having a foot 45 lie on the shafts of the needles. Each sinker is at its end opposite to the foot 45 is fork-like and is positioned at said opposite end in a sinker bed 46. Sinker 44 is lockable in its bed in three positions by wires 47.

Figure 1:
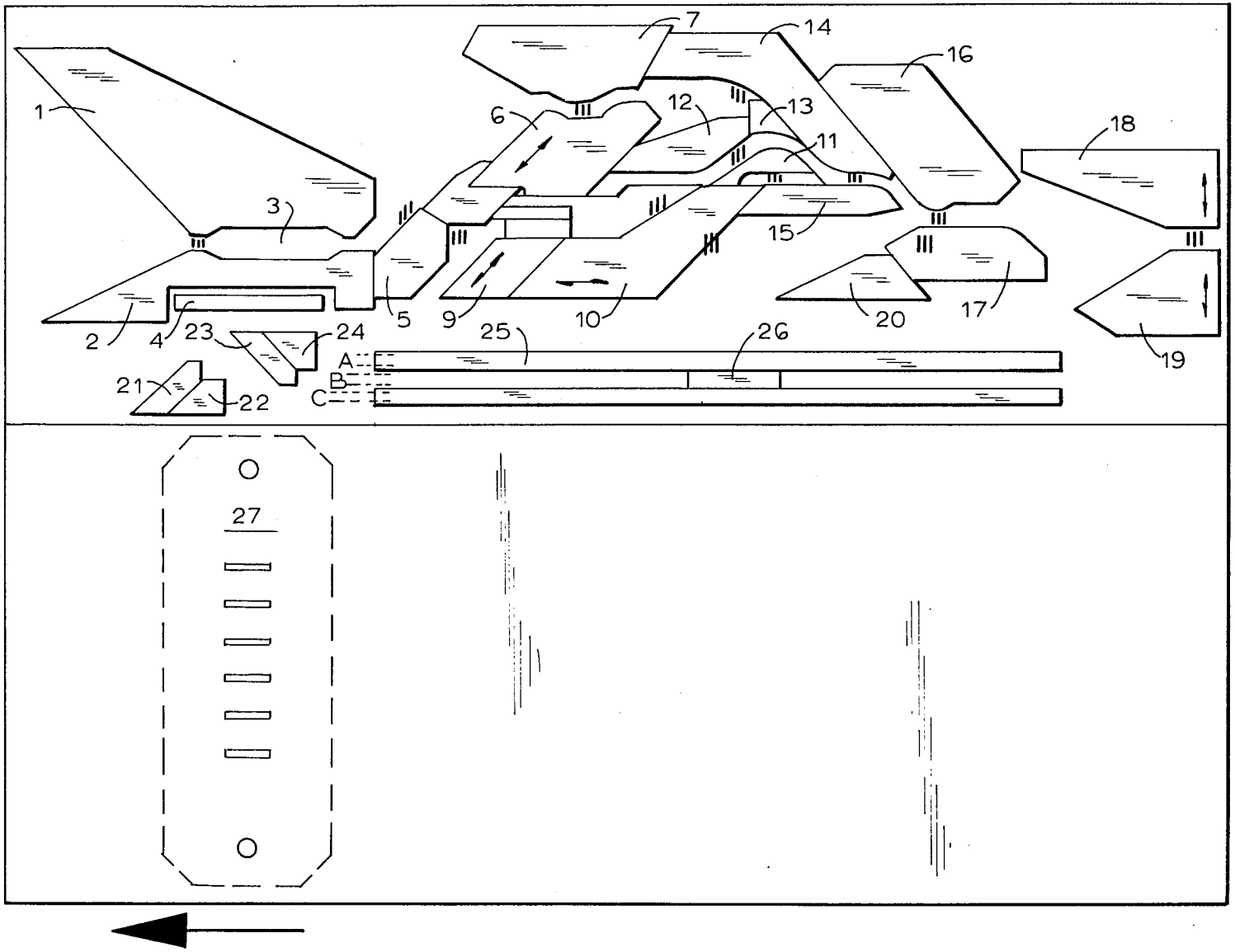
FIG. 1 is a schematic view of the combined knitting and loop-transfer cam for a needle bed.

Sinker cams 21–24 shown in FIG. 1 act on sinkers 44 and pressure bars 25, 26 and 48 act on the foot 45 of each sinker. Sinker cams 21–24 serve to bring sinkers 44 into one of three possible positions and thereby define the sinker tracks A, B or C (FIG. 1). The foot of sinker 44 is moved thereby to lie under the one of the pressure strips 25, 26 or 48. If one of the printing bars 25, 26, 48 is actuated it moves the foot 45 downwardly so that this sinker pushes the assigned knitting needle 40 also downwardly against the force of the spring pin 43 in the needle bed 42 and thus forces the foot 41 of the knitting needle 40 out of the engagement with cam 10. Depending on how long are pressing strips 25, 26, 48 the sinker 44 and the knitting needle 40 therewith are pushed downwardly as far as the cam of the knitting machine would be moved, and depending on the positions of individual cams the knitting needle 40 would form the loop or floating in the knitted texture. As soon as the pressure strips 25, 26, 48 are again brought to the basic position the knitting needle 40 would be again moved upwardly by the spring pins 43.

A combined knitting and loop-transfer cam device shown in FIG. 1 is normally provided at each knitting carriage for a two-part needle bed and provides simultaneously, in a course of the carriage a knitted pattern, a pattern loop transfer from one needle bed to the other needle bed or simultaneously in both directions and also pattern combinations of knits and loop transfers. The combined knitting and loop-transfer cam device comprises two inflow cams 1 and 2 for bringing jointly knitting needles to a comb position in which the needle heads with the knock over verge wall are positioned at the height of the needle beds. Inflow cams 1 and 2 have recesses 3 for collecting elements d. Knitting needles are pushed over a pressure bar 4.

A switchable cam 5 closes the inflow cams 1 and 2. A needle course or track for knits, a tack loop formation, a loop transfer and a loop acceptance are released by the cam 5. For the loop transfer, a displaceable loop transfer cam 6 with a safety device 7 is provided for a precise adjustment of the loop transfer position in the direction of elongation of the needles whereas a tuck drive cam is connected to the cam 5 for the loop acceptance and the tuck loop formation. This tuck drive cam is provided for an optimal adjustment of the tuck and loop acceptance position in the direction of elongation of the needle. A displaceable cam 9 is arranged in the direction of elongation of the carriage. Behind the tuck drive cam in the direction of elongation of the carriage, is positioned a clearing cam 11 which, together with an opposite limiting cam 12 and the switchable cam 13, forms a cam channel for a reliable guidance of the fully driven knitting needles. If the cam 13 is lowered the path for the pulling of the knitting needles arriving from the loop transfer position and guided by a limiting cam 14 is free.

A guide cam 15 is arranged behind the clearing cam 11. The guide cam 15 together with the limiting cam 14 guides the knitting needles to the needle spring cam 16. A guard cam 17 corresponds to the needle spring cam 16. Combing cams 18, 19 for ensuring the position of the knitting needles, in which the needle heads with knock over verge wall are positioned at the level of the needle beds, are provided before the next knitting system. These combing cams 18, 19 are adjustable to a material being processed and to knit binding in the needle raising position. For bringing the knitting needles pushed during the running of the carriage to the comb synchronizing position, a further cam 20 is arranged before the guard cam 17.

Upon running of the knitting carriage over the needle beds, sinkers corresponding to the knitting needles are brought over sinker cams 21, 22, 23 and 24 onto sinker tracks A, B or C. The sinker cams 21, 22, 23 and 24 operate when a selecting of individual needles is realized. The pressure bar 4 pushes the knitting needles, over the time of selection for releasing the selecting system 27, into the needle bed whereby the needles are collected in the recess 3 of the inflow cams 1 and 2.

By means of the selecting system 28 sinkers 44 and needles 40 are individually selected. Selecting system 27 may be a conventional electronic device.

The knitting needles selected in correspondence with the sinkers move now, after a respective switching of the cam cam 5, to the loop transfer member 6 or to the tuck cam and finally to the clearing cam 11. The knitting needles, not brought to the operative position in accordance with a pattern being produced, are pressed over a printing strip 25 from the engagement range of the knitting cam so that they can be moved over the guard cam 17 again to the comb synchronizing position. In order to produce tuck loops and loop acceptance, the knitting needles are moved after switching off the cam member 5, to the cam 9 and 10. The needles are then guided again either by the switching the clearing cam 11 or over the sinker track B and the printing bar 26 to the guide and limiting cams 15, 14 and to the needle spring cam 16 with the guard cam 17.

For the taking-off of the knitting needles from the loop transfer or loop acceptance position, the cam 13 is lowered. The knitting needles are moved over the uniform needle track further as the loop-forming knitting needles, namely over the guide and limiting cams 15, 14 towards the needle spring cam 16 with the guard cam 17 up to the combing cams 18, 19.

Figure 2:
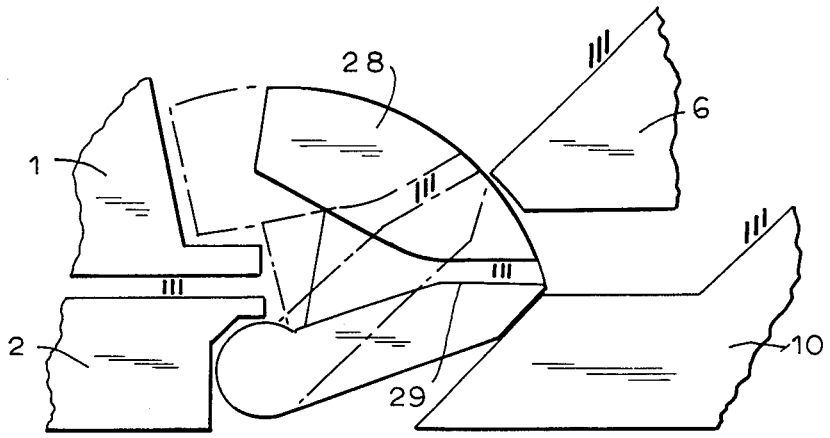
FIG. 2 is a schematic view of the cam element for selecting knitting needles for loop-transfer, in an outlet position.

It is also conceivable, as shown in FIG. 2, to replace the cam 5 with a rotation member 28. In this case the knitting needles are guided in a form-locking fashion by the rotating member 28 provided with a track 25 towards the tuck drive cam or loop transfer cam 6.

Figure 3:
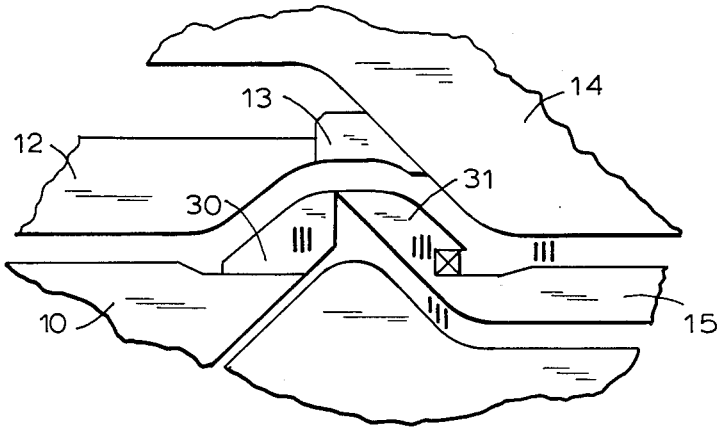
FIGS. 3 and 4 are schematic view of further modifications of the driving and needle-returning parts.
Figure 4:
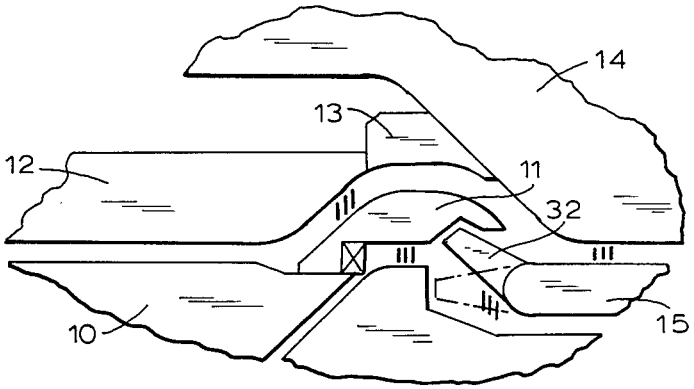

In order to obtain pulling of the knitting needles at different times, after the tuck loop formation or loop acceptance and loop transfer, an embodiment including the subdivision of the clearing cam 11 is shown in FIG. 3. A clearing cam 30 which drives the knitting needles is formed as a switchable cam while a second cam 31 of the two-part clearing cam 11 for guiding the knitting needles to the delivery position is stationary. A needle channel is released by pressing or pushing the clearing cam 30 and thereby the timely delivery of the certain knitting needles for the loop acceptance and loop transfer is ensured by the sinker track B and the pressure bar 26.

Finally it is also possible to arrange a switchable cam tongue 32 in the extension of the guide cam 15 in the backward direction, whereby various combinations of the knitting needles in connection with the selection of the sinkers are possible.

It will be understood that each of the elements described above, or two or more together, may also find a useful application in other types of combined knitting and loop transfer cams for flax knitting machines differing from the types described above.

While the invention has been illustrated and described as embodied in a combined knitting and loop transfer cam for flax knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a combined knitting and loop transfer cam arrangement for knitting machines, comprising a knitting carriage running in one direction over the needle beds, knitting needles, sinkers in accordance to which the knitting needles are selected for a pattern-responsive knitting process, pressure bars for pressing the knitting needles away from a influence range of a cam system, inflow cams, loop acceptance and loop transfer cams, tuck cams, clearing cams, needle spring cams and limiting cams, wherein a clearing cam serves at the same time for a loop acceptance and for separating of a knitting needle course for a loop transfer, and a first switchable cam (5) is provided for loop acceptance and tuck-or-loop formation, the improvement comprising a switchable pressure bar (4) for pressing the knitting needles during a sinker selection; a selecting system (27) for sinkers, said switchable pressure bar being arranged at the height of said inflow cams over a region of said selecting system, a tuck cam positioned subsequent to said first switchable cam (5) for optimal adjustment of a tuck and loop transfer position and subdivided into a first cam member (9) displaceable in the direction of elongation of the needles and a second cam member (10) displaceable in the direction of moving of the knitting carriage; a second switchable cam (13) for a form-locking guidance of the knitting needles in the region of a clearing cam (11) and for freeing a path for the knitting needles arriving from a loop transfer position to a limiting cam (12); and combing cams (18, 19) for adjustment to a material being knitted and to a binding formed in the direction of raising of the needles.

2. The cam arrangement as defined in claim 1, wherein said inflow cams are provided with a recess (3) for collecting the knitting needles pressed by said pressure bar.

3. The cam arrangement as defined in claim 1, wherein said first switchable cam (5) is formed as a rotation element (28) provided with a track (29) for guiding the knitting needles in a form-locking fashion in the region of at least a loop-transfer cam (6) and said second cam member (10).

4. The cam arrangement as defined in claim 1, wherein the clearing cam (11) is subdivided into a first switchable portion (30) for clearing the knitting needles, and a second portion (31) for guiding the knitting needles to a delivery position for enabling the knitting needles to be pulled at different times, after the tuck loop formation or loop acceptance and the loop formation or loop transfer.

5. The cam arrangement as defined in claim 1, wherein a guide cam (15) is provided with a forwardly projecting extension formed as a pivotable cam tongue (32) positioned below the clearing cam (11) for enabling the knitting needles to be cleared at different times, after the tuck loop formation or loop transfer.

* * * * *